US010384468B2

(12) United States Patent
Asao et al.

(10) Patent No.: US 10,384,468 B2
(45) Date of Patent: Aug. 20, 2019

(54) RECORDING METHOD, RECORDED MATTER, RECORDED MATTER PROCESSING METHOD, AND METHOD FOR IMPROVING FOLD-CRACK RESISTANCE OF RECORDED MATTER

(71) Applicant: CANON KABUSHIKI KAISHA, Tokyo (JP)

(72) Inventors: Masaya Asao, Yokohama (JP); Tatsuo Senba, Kodaira (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/052,589

(22) Filed: Feb. 24, 2016

(65) Prior Publication Data

US 2016/0250867 A1 Sep. 1, 2016

(30) Foreign Application Priority Data

Feb. 26, 2015 (JP) ..... 2015-037023

(51) Int. Cl.
*B41J 2/015* (2006.01)
*B41J 11/00* (2006.01)
*B41M 7/00* (2006.01)

(52) U.S. Cl.
CPC ..... *B41J 11/0015* (2013.01); *B41M 7/0036* (2013.01)

(58) Field of Classification Search
None
See application file for complete search history.

(56) References Cited

U.S. PATENT DOCUMENTS 5,376,434 A 12/1994 Ogawa
7,445,884 B2 * 11/2008 Yanagisawa ..... G03C 1/49881 347/228
2001/0030677 A1 * 10/2001 Inamoto ..... B41J 2/01 347/101
2002/0196322 A1 * 12/2002 Fujii ..... B41M 5/52 347/105
2003/0220036 A1 * 11/2003 Lee ..... B32B 23/02 442/153
2005/0255996 A1 * 11/2005 Tamura ..... B41M 5/30 503/204
2010/0309260 A1 * 12/2010 Hakiri ..... C09D 11/324 347/56

(Continued)

FOREIGN PATENT DOCUMENTS

EP 2623330 A1 8/2013
EP 2752303 A1 7/2014

(Continued)

*Primary Examiner* — Matthew Luu
*Assistant Examiner* — Tracey M McMillion
(74) *Attorney, Agent, or Firm* — Canon U.S.A., Inc. IP Division

(57) ABSTRACT

A recording method includes an ink application process of applying ink to a record medium and a cover layer formation process of forming a cover layer by applying a liquid composition containing polyurethane resin particles to the record medium to which the ink is applied in such a manner as to be at least partially overlapped with a region to which the ink is applied, in which the breaking strength of the cover layer is 0.1 N or more and the breaking elongation of the cover layer is 200% or more.

12 Claims, 2 Drawing Sheets

(56) References Cited

U.S. PATENT DOCUMENTS

| | | | | |
|---|---|---|---|---|
| 2011/0297555 | A1* | 12/2011 | Stiene | A61B 5/1486<br>205/789 |
| 2014/0313526 | A1* | 10/2014 | Davidson | B41M 3/008<br>358/1.6 |

FOREIGN PATENT DOCUMENTS

| | | | | |
|---|---|---|---|---|
| JP | 0177240 | A | * | 6/2000 |
| JP | 2001096898 | A | | 4/2001 |
| JP | 2002240414 | A | | 8/2002 |
| JP | 0145574 | A | * | 5/2003 |
| JP | 0159861 | A | * | 6/2003 |
| JP | 2003159861 | A | * | 6/2003 |
| JP | 2003170660 | A | | 6/2003 |
| JP | 2008183807 | A | | 8/2008 |
| JP | 2010042931 | A | | 2/2010 |
| JP | 2013176972 | A | | 9/2013 |

* cited by examiner

RECORDING METHOD, RECORDED MATTER, RECORDED MATTER PROCESSING METHOD, AND METHOD FOR IMPROVING FOLD-CRACK RESISTANCE OF RECORDED MATTER

BACKGROUND OF THE INVENTION

Field of the Invention

The present invention relates to a recording method, recorded matter, a recorded matter processing method, and a method for improving the fold-crack resistance of recorded matter.

Description of the Related Art

In recent years, a demand for a photobook employing an ink jet record medium and the like has increasingly grown. As a method for producing the photobook, a method is mentioned which includes giving a fold beforehand to a plurality of ink jet record media having an image recorded only on one surface, and then bonding the surfaces on which no images are recorded at the fold as the boundary. By such a method, a photobook in which large images spreading across pages are seemingly disposed on record media can be produced.

As a problem in such a use, when a fold has been given to recorded matter, an ink receiving layer of a record medium has been broken or the like, so that an image has been partially cracked or peeled in some cases. Even when a fold has not been positively given unlike the production of the photobook, recorded matter has been unintentionally cracked during storage and the like, so that an image has been partially cracked or peeled in some cases. Then, a demand for a recording method capable of producing recorded matter free from cracking or peeling of an image when a fold is given or a fold is unintentionally given, i.e. high fold-crack resistance, has increased.

Heretofore, as a method for improving the fold-crack resistance of recorded matter, a method is known which includes providing an undercoat layer containing a water-soluble resin between an ink receiving layer and a substrate of a record medium (Japanese Patent Laid-Open Nos. 2001-096898 and 2008-183807). Since the undercoat layer eases a stress when a fold is given, the fold-crack resistance is improved. Moreover, a method for improving the fold-crack resistance of recorded matter by devising a binder to be blended in an ink receiving layer is also known (Japanese Patent Laid-Open No. 2003-170660). Japanese Patent Laid-Open No. 2003-170660 describes improving the fold-crack resistance of recorded matter by the use of polyvinyl alcohol having a high polymerization degree of 4,100 or more as a binder to be blended in an ink receiving layer.

On the other hand, a method for applying anionic urethane resin particles to an image is also known in order to improve the weatherability of an image (Japanese Patent Laid-Open No. 2002-240414).

SUMMARY OF THE INVENTION

The purpose described above is achieved by the present invention described below.

A first embodiment of the present invention is a recording method including an ink application process of applying ink to a record medium and a cover layer formation process of forming a cover layer by applying a liquid composition containing polyurethane resin particles to the record medium to which the ink is applied in such a manner as to be at least partially overlapped with a region to which the ink is applied, in which the breaking strength of the cover layer is 0.1 N or more and the breaking elongation of the cover layer is 200% or more.

A second embodiment of the present invention is recorded matter having a substrate and an ink receiving layer containing a coloring material, in which a cover layer containing polyurethane resin is provided in such a manner as to be at least partially overlapped with a region containing the coloring material of the ink receiving layer and the breaking strength of the cover layer is 0.1 N or more and the breaking elongation of the cover layer is 200% or more.

A third embodiment of the present invention is a recorded matter processing method including a folding processing process of folding recorded matter obtained by applying ink to a record medium, and the method includes a cover layer formation process of forming a cover layer by applying a liquid composition containing polyurethane resin particles before the folding processing process, in which the breaking strength of the cover layer is 0.1 N or more and the breaking elongation of the cover layer is 200% or more.

A fourth embodiment of the present invention is a method for improving the fold-crack resistance of recorded matter obtained by applying ink to a record medium, and the method includes a cover layer formation process of forming a cover layer by applying a liquid composition containing polyurethane resin particles to at least one part of the recorded matter, in which the breaking strength of the cover layer is 0.1 N or more and the breaking elongation of the cover layer is 200% or more.

The present invention can provide a recording method capable of producing recorded matter excellent in fold-crack resistance. Moreover, the present invention can provide recorded matter excellent in fold-crack resistance, a processing method capable of producing recorded matter excellent in fold-crack resistance, and a method for improving the fold-crack resistance of recorded matter.

Further features of the present invention will become apparent from the following description of exemplary embodiments with reference to the attached drawings.

DESCRIPTION OF THE EMBODIMENTS

Figure 1:
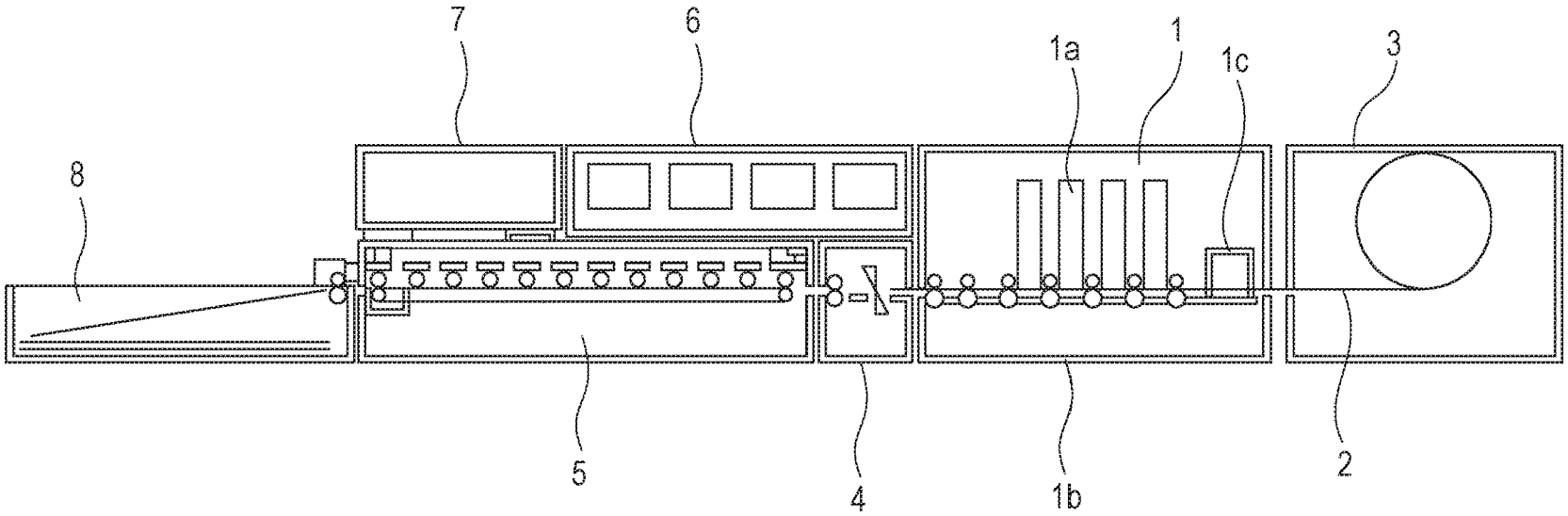
FIG. 1 is a cross sectional view illustrating an example of the configuration of an ink application means in the present invention.

However, according to an examination of the present inventors, with the record media described in Japanese Patent Laid-Open Nos. 2001-096898, 2008-183807, and 2003-170660, the fold-crack resistance of recorded matter to be obtained has not been sufficient. Moreover, also in recorded matter to be obtained by the method described in Japanese Patent Laid-Open No. 2002-240414, the fold-crack resistance has not been sufficient.

Therefore, the present invention provides recorded matter excellent in fold-crack resistance, a recording method capable of producing recorded matter excellent in fold-crack resistance, a recorded matter processing method, and a method for improving the fold-crack resistance of recorded matter.

Hereinafter, suitable embodiments of the present invention are described in detail with reference to a first embodiment. Parts common to the parts of the first embodiment of the second to fourth embodiments are the same as the parts of the first embodiment.

Recording Method

A recording method according to the first embodiment of the present invention at least includes (1) an ink application process of applying ink to a record medium and (2) a cover layer formation process of forming a cover layer by applying a liquid composition containing polyurethane resin particles to the record medium to which the ink is applied in such a manner as to be at least partially overlapped with a region to which the ink is applied. The recording method may further include (3) a folding processing process of folding recorded matter and (4) other processes. Each of these processes is described below.

(1) Ink Application Process

As a system for applying ink to a record medium, it is suitable to use an ink jet system. As the ink jet system, a so-called thermal ink jet system of causing thermal energy to act on ink to eject the ink from an ejection port of a recording head or a so-called piezoelectric ink jet system of ejecting ink from an ejection port of a recording head using a piezoelectric element may be acceptable.

As the recording head, a so-called serial type ink jet recording head which performs recording by scanning a recording head in a direction crossing the conveyance direction of a record medium and a so-called full line type ink jet recording head in which a plurality of nozzles are arranged in a range covering the maximum width of a record medium which is assumed to be used may be acceptable. From the viewpoint of recording an image at a higher speed, the recording head is suitably the full line type ink jet recording head. It is suitable to provide the full line type ink jet recording head in such a manner that nozzle rows are arranged perpendicularly to the conveyance direction of a record medium. It is also suitable to provide two or more of the full line type ink jet recording heads corresponding to ink colors and each recording head is arranged in parallel along the conveyance direction.

Record Medium

As the record medium for use in the present invention, any known record medium can be used. It is particularly suitable to use an ink jet record medium having a substrate and an ink receiving layer. Furthermore, it is suitable to use a record medium having two ink receiving layers of a lower ink receiving layer and an upper ink receiving layer on the substrate in the present invention. Hereinafter, the substrate and the ink receiving layer configuring the record medium are individually described.

Substrate

It is suitable to use a water resistant substrate as the substrate in the present invention. Examples of the water resistant substrate include, for example, a resin coated paper in which a base paper is coated with resin, a synthetic paper, a plastic film, and the like. As the water resistant substrate, it is particularly suitable to use the resin coated paper.

As the base paper of the resin coated paper, plain paper and the like which are generally used can be used and smooth paper which is used for a substrate for photographs is suitable. In particular, those having high surface smoothness which are subjected to surface treatment of compressing paper by applying pressure by a calendar or the like during or after paper making are suitable. As pulp configuring the paper, natural pulp, regenerated pulp, synthetic pulp, and the like are used alone or as a mixture of two or more kinds thereof, for example. To the paper, additives generally used in paper manufacturing, such as a sizing agent, a paper reinforcing agent, a filler, an antistatic agent, a fluorescent brightening agent, and a dye, may be blended. Furthermore, a surface sizing agent, a surface strength agent, a fluorescent brightening agent, an antistatic agent, a dye, an anchor agent, and the like may be applied to the surface. The density of the base paper is preferably 0.6 g/cm$^3$ or more and 1.2 g/cm$^3$ or less. The density is more preferably 0.7 g/cm$^3$ or more. When the density is 1.2 g/cm$^3$ or less, a reduction in cushioning properties and a reduction in conveyance properties can be suppressed. When the density is 0.6 g/cm$^3$ or more, a reduction in surface smoothness can be suppressed. The film thickness of the base paper is suitably 50.0 μm or more. When the film thickness is 50.0 μm or more, tensile strength, tear strength, and texture increase. The film thickness of the base paper is suitably 350.0 μm or less in terms of productivity and the like. The film thickness of the resin (resin layer) coating the base paper is preferably 5.0 μm or more and more preferably 8.0 μm or more. The film thickness is preferably 40.0 μm or less and more preferably 35.0 μm or less. When the thickness is 5.0 μm or more, permeation of water and gas into the base paper is suppressed and the occurrence of cracking in the ink receiving layer due to folding can be suppressed. When the film thickness is 40.0 μm or less, the curling resistance can be improved. As the resin, low-density polyethylene (LDPE) and high-density polyethylene (HDPE) are used, for example. In addition thereto, a linear low-density polyethylene (LLDPE), polypropylene, and the like may be used. Particularly for the resin layer on the side (front surface side) on which the ink receiving layer is to be formed, it is suitable to add a rutile or anatase type titanium oxide, a fluorescent brightening agent, and ultramarine into polyethylene to improve the opacity, the whiteness degree, and the hue. When titanium oxide is blended in the resin layer, the content of the titanium oxide is preferably 3.0 mass % or more and more preferably 4.0 mass % or more based on the total amount of the resin. The content of the titanium oxide is preferably 20.0 mass % or less and more preferably 13.0 mass % or less.

Examples of the plastic film include, for example, films produced from a thermoplastic resin, such as polyethylene, polypropylene, polystyrene, polyvinyl chloride, and polyester, and a thermosetting resin, such as urea resin, melamine resin, and phenol resin. The film thickness of the plastic film is preferably 50.0 μm or more and 250.0 μm or less.

The surface quality of the water resistant substrate can be set to a desired surface quality, such as a gloss surface, a semi-gloss surface, and a mat surface. Among the above, the surface of the water resistant substrate is suitably set to a semi-gloss surface or a mat surface. The surface of the water resistant substrate can be set to a semi-gloss surface or a mat surface by, for example, performing embossing processing by bringing a base paper into contact with a roller having an irregular pattern under pressure when melt-extruding the resin onto the front surface of the base paper for coating. When the ink receiving layer is formed on the substrate having a semi-gloss surface or a mat surface, irregularity reflecting the irregularity of the substrate is formed on the front surface of the ink receiving layer, i.e., the front surface of a record medium. As a result, glare due to excessively high gloss can be suppressed. The adhesion surface area of the substrate and the ink receiving layer is large, so that the fold-crack resistance is improved. The arithmetic average roughness (Ra) when the cutoff value specified by JIS B 0601:2001 of the front surface of the record medium is 0.8 mm is preferably 0.3 μm or more and 6.0 μm or less and more preferably 0.5 μm or more and 3.0 μm or less. Due to the fact that the arithmetic average roughness is 0.3 μm or more and 6.0 μm or less, good glossiness can be obtained.

In the present invention, a primer layer containing hydrophilic polymers, such as gelatin and polyvinyl alcohol, as the main component may be provided on the surface on which the ink receiving layer is to be provided of the substrate. Alternatively, easy adhesion processing by corona discharge, plasma treatment, and the like may be performed. Thus, the adhesiveness between the substrate and the ink receiving layer can be increased.

Ink Receiving Layer

The ink receiving layer is formed from an inorganic pigment, a binder, and the like. The inorganic pigment is not particularly limited and, for example, any inorganic pigment, such as alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide, can be suitably used. Among the above, it is suitable to use alumina, alumina hydrate, and silica which form a good porous structure and have good ink absorbency as the inorganic pigment. Two or more kinds of these inorganic pigments may be used in combination. More specifically, it is suitable to use at least one kind selected from alumina, alumina hydrate, and silica as the inorganic pigment.

The binder is suitably a water-soluble resin. As the binder, for example, natural polymer resin, such as polyvinyl alcohol and a derivative thereof, starch and a derivative thereof, gelatin and a derivative thereof, casein, pullulan, gum arabic, karaya gum, and albumin, or derivatives thereof, latex, such as cation-modified SBR latex, NBR latex, methyl methacrylate butadiene copolymer, and ethylene-vinyl acetate copolymer, vinyl polymers, such as polyacrylamide and polyvinyl pyrrolidone, polyethyleneimine, polypropylene glycol, polyethylene glycol, maleic anhydride or a copolymer thereof, and the like can be mentioned and the substances mentioned above can be used alone or in combination of two or more kinds thereof.

Among the binders mentioned above, it is suitable to use at least one kind selected from polyvinyl alcohol and polyvinyl alcohol derivatives because an ink receiving layer with high strength is obtained. Examples of the polyvinyl alcohol derivatives include cation-modified polyvinyl alcohol, anion-modified polyvinyl alcohol, silanol-modified polyvinyl alcohol, polyvinyl acetal, and the like.

It is also suitable to blend one or more kinds of boron compounds as a material for crosslinking (crosslinking agent) the binder in the ink receiving layer. Examples of the boron compounds include orthoboric acid ($H_3BO_3$), metaboric acid, hypoboric acid, salts of these boron compounds, and the like. The salts of the boron compounds are suitably water-soluble salts of the boron compounds mentioned above. Specific examples of the water-soluble salts of the boron compounds include, for example, alkali metal salts, such as sodium salts ($Na_2B_4O_7.10H_2O$, $NaBO_2.4H_2O$, and the like) and potassium salts ($K_2B_4O_7.5H_2O$, $KBO_2$, and the like) of boron compounds; ammonium salts of boron compounds ($NH_4B_4O_9.3H_2O$, $NH_4BO_2$, and the like); and the like. It is suitable to use orthoboric acid from the viewpoint of stability with time of a coating liquid and an effect of suppressing the occurrence of cracking.

Moreover, a deflocculation agent for uniformly dispersing the inorganic pigments in solvents, such as water, and a cationic polymer for improving water resistance may be contained. For example, by the use of acids as the deflocculation agent in the case where alumina hydrate is used as the inorganic pigment, a dispersion in which the alumina hydrate is uniformly dispersed can be obtained. Examples of the acids serving as the deflocculation agent include organic acids, such as acetic acid, formic acid, oxalic acid, and alkyl sulfonic acids (methanesulfonic acid, ethane sulfonic acid, butane sulfonic acid, iso-propanesulfonic acid, and the like); and inorganic acids, such as nitric acid, hydrochloric acid, and sulfuric acid, among generally known acids.

Examples of suitable cationic polymers in the case where silica is used as the inorganic pigment include, for example, quaternary ammonium salt, polyamine, alkylamine, halogenated quaternary ammonium salt, cationic urethane resin, amine.epichlorohydrin polyaddition product, dihalide.diamine polyaddition product, polyamidine, vinyl (co)polymer, polydiallyl dimethyl ammonium chloride, polymethacryloyloxyethyl-β-hydroxyethyl dimethyl ammonium chloride, polyethyleneimine, polyallylamine and a derivative thereof, polyamide-polyamine resin, cationized starch, dicyandiamide formalin condensate, dimethyl-2-hydroxypropyl ammonium salt polymer, polyamidine, polyvinyl amine, dicyan-based cationic resin, polyamine-based cationic resin, epichlorohydrin-dimethylamine addition polymer, dimethyl diallyl ammonium chloride-$SO_2$ copolymer, diallyl amine salt-$SO_2$ copolymer, (meth)acrylate containing polymer having a quaternary ammonium base-substituted alkyl group in an ester portion-styryl type polymer having a quaternary ammonium base-substituted alkyl group, polyamide-based resin, polyamide epichlorohydrin-based resin, polyamide polyamine epichlorohydrin-based resin, and the like.

For the ink receiving layer, it is also suitable to use a sulfur-containing high molecular weight compound in combination. By the combined use, effects that the fastness, such as light fastness and gasfastness, of a coloring material is improved and the occurrence of bleeding or a roller mark can be more effectively suppressed can be demonstrated. Considering the dyeing position of the coloring material, it is suitable to blend a large amount of the sulfur-containing high molecular weight compound in an upper layer from the viewpoint of the fastness of the coloring material. The content of the sulfur-containing high molecular weight compound in the upper layer is preferably 0.1 mass % or more and 10 mass % or less and more preferably 0.5 mass % or more and 6 mass % or less based on the total mass of the upper layer.

Moreover, the following additives may be added to the ink receiving layer. For example, a thickening agent, a pH adjuster, a lubricant, a fluidity modifying agent, a surfactant, an antifoaming agent, a water resistance imparting agent, a foam inhibitor, a mold release agent, a foaming agent, a penetrant, a coloring dye, a fluorescent brightening agent, an ultraviolet absorber, an antioxidant, an antiseptic, and a mildewproof agent are mentioned.

Record Medium Having Upper Layer and Lower Layer

In the present invention, it is suitable to use a record medium having two ink receiving layers of a lower ink receiving layer and an upper ink receiving layer on a substrate. It is suitable that the substrate and the lower layer are adjacent to each other and the surface opposite to the surface adjacent to the substrate of the lower layer is adjacent to the upper layer. A thin film may be provided further on the upper layer, between the upper layer and the lower layer, or between the lower layer and the substrate. The film thickness of the thin film is suitably set to 0.1 μm or more and 3.0 μm or less. In particular, it is suitable to provide a surface layer containing colloidal silica on the upper layer as the thin layer in the respects of glossiness and scratch resistance.

As the film thickness of the ink receiving layer, the total film thickness of the upper layer and the lower layer is preferably 15.0 μm or more, more preferably 20.0 μm or more, and particularly preferably 25.0 μm or more. The film thickness is set to preferably 50.0 μm or less and more preferably 40.0 μm or less. Due to the fact that the film thickness of the ink receiving layer is 15.0 μm or more and 50.0 μm or less, the fold-crack resistance, the ink absorbency, and further the image density can be made good. In the present invention, it is most suitable that the film thickness of the ink receiving layer is set to 30.0 μm or more and 38.0 μm or less. The film thickness of the ink receiving layer in the present invention refers to the film thickness in an absolute dry condition and is the average value obtained by measuring the film thickness of four points of a cross section using a scanning electron microscope. In the present invention, the film thickness measurement target is a quadrangle and portions 1 cm apart from the four corners in the center of gravity of the quadrangle are the four points.

Both of the two ink receiving layers contain inorganic particles, a binder, and a crosslinking agent. It is suitable that the ratio of the content of the crosslinking agent to the content of the binder is lower in the lower layer than in the upper layer from the viewpoint of improving the fold-crack resistance. When the ratio of the content of the crosslinking agent to the content of the binder in the ink receiving layer is higher, the degree of crosslinking of the ink receiving layer increases, so that the ink receiving layer tends to become hard. By reducing the ratio of the content of the crosslinking agent to the content of the binder in the lower layer to be lower than that of the upper layer, the lower layer becomes soft, and therefore the flexibility of the entire record medium is improved, so that a stress applied when the record medium is folded can be eased.

In the present invention, the ratio of the content of the crosslinking agent to the content of the binder particularly in the lower layer is preferably 2.0 mass % or more and 7.0 mass % or less. The ratio of the content of the crosslinking agent to the content of the binder in the upper layer is preferably 10.0 mass % or more and 30.0 mass % or less. Furthermore, the ratio of the content of the crosslinking agent to the content of the binder in the lower layer is more preferably 3.0 mass % or more and 6.5 mass % or less. The ratio of the content of the crosslinking agent to the content of the binder in the upper layer is more preferably 12.0 mass % or more and 25.0 mass % or less.

In the present invention, the ratio of the content of the crosslinking agent to the content of the binder in a coating liquid for lower layer is preferably 2.0 mass % or more and 7.0 mass % or less. The ratio of the content of the crosslinking agent to the content of the binder in a coating liquid for upper layer is preferably 10.0 mass % or more and 30.0 mass % or less. Furthermore, the ratio of the content of the crosslinking agent to the content of the binder in the coating liquid for lower layer is more preferably 3.0 mass % or more and 6.5 mass % or less. The ratio of the content of the crosslinking agent to the content of the binder in the coating liquid for upper layer is more preferably 12.0 mass % or more and 25.0 mass % or less.

Furthermore, the ratio of the binder to the inorganic pigment is suitably lower in the upper layer than in the lower layer. This is because, by the above-described configuration, the adhesiveness of the upper layer and the lower layer is improved and the fold-crack resistance is improved.

In the present invention, the ratio of the content of the binder to the content of the inorganic particles particularly in the lower layer is preferably 11.0 mass % or more and 40.0 mass % or less. The ratio of the content of the binder to the content of the inorganic particles in the upper layer is preferably 5.0 mass % or more and 10.0 mass % or less. Furthermore, the ratio of the content of the binder to the content of the inorganic particles in the lower layer is more preferably 12.0 mass % or more and 30.0 mass % or less. The ratio of the content of the binder to the content of the inorganic particles in the upper layer is more preferably 6.0 mass % or more and 9.0 mass % or less.

Ink

Coloring Material

As a coloring material to be blended in ink, dyes and pigments, such as organic pigments and inorganic pigments, are mentioned, and the dyes and the pigments can be used alone or in combination of two or more kinds thereof. The content of the coloring material in ink is preferably 0.1 mass % or more and 10.0 mass % or less and more preferably 0.3 mass % or more and 8.0 mass % or less based on the total mass of the ink. As the hue of the coloring material, coloring materials having the hues of black, cyan, magenta, yellow, red, green, blue, and the like can be used.

In the present invention, it is particularly suitable to use a dye as the coloring material because it is easy to increase the quality of a recorded image to be comparable to the quality of a silver halide photography. It is suitable to use dyes having water solubility due to the presence of anionic groups, such as a sulfonic acid group and a carboxy group. Specifically, acid dyes, direct dyes, reactive dyes, and the like listed in COLOUR INDEX are mentioned. Moreover, any dye at least having anionic groups, such as a sulfonic acid group and a carboxy group, can be used even when the dyes are not listed in COLOUR INDEX.

Aqueous Medium

An aqueous medium which is a mixed solvent of water and a water-soluble organic solvent can be blended in ink. The content of the water in the ink is suitably 50.0 mass % or more and 95.0 mass % or less based on the total mass of the ink. The content of the water-soluble organic solvent in the ink is suitably 2.0 mass % or more and 50.0 mass % based on the total mass of the ink.

As the water, it is suitable to use deionized water or ion exchange water. As the water-soluble organic solvent, any substance usable in ink jet ink, such as monohydric or polyhydric alcohols, glycols, glycol ethers, and nitrogen containing compounds, can be used, and one kind or two or more kinds thereof can be blended in ink. In the present invention, it is suitable to use at least one kind of water-soluble organic solvent having a vapor pressure at 25° C. higher than that of water because the moisture retention properties are excellent and the sticking resistance can be improved.

In the present invention, it is suitable from the viewpoint of the fold-crack resistance of recorded matter that the ink to be applied to a record medium contains polyhydric alcohols and glycols as the water-soluble organic solvent. The polyhydric alcohols and glycols have a plurality of hydroxyl groups in the structure. When the ink is applied to a record medium, the polyvinyl alcohol and a derivative thereof used as the binder of the cover layer or the record medium are plasticized due to the action of the plurality of hydroxyl groups, and therefore it is considered that the record medium and the recorded matter are further softened, so that the fold-crack resistance is improved. Among the polyhydric alcohols and the glycols, at least one kind selected from alkyl diols and glycerols is more suitable and at least one kind selected from 1,5-pentane diol and glycerol is particularly suitable.

Other Additives

In the present invention, water-soluble organic compounds which are solid at normal temperature (25° C.), such as urea and a derivative thereof, and polyhydric alcohols, such as trimethylol propane and trimethylolethane, may be blended in ink. Moreover, in addition to the components described above, various additives, such as a surfactant, a pH adjuster, an antirust, an antiseptic, an antifungal agent, an antioxidant, a reduction inhibitor, an evaporation promoter, a chelating agent, and a water-soluble polymer, can be blended as necessary.

(2) Cover Layer Formation Process

In the recording method according to the first embodiment in the present invention, a cover layer formation process is a process of forming a cover layer by applying a liquid composition containing polyurethane resin particles to a record medium to which ink is applied in such a manner as to be at least partially overlapped with a region to which the ink is applied. As a method for applying the liquid composition, an ink jet system, an applying method, and the like are mentioned and the applying method is suitable. As the applying method, applying methods by, for example, a roller coating method, a bar coating method, a spray coating method, and a brush and the like are mentioned, for example. In particular, in order to form a cover layer excellent in fold-crack resistance, it is suitable to apply 3 $g/m^2$ or more of the liquid composition as the application amount in terms of solid content of the liquid composition described later. In order to form such a cover layer by one application, it is suitable to apply the liquid composition using a roll type coating device (hereinafter also referred to as a "pumping-up roll type coating device") having a pan (a liquid composition storage container) storing the liquid composition and a roll applying the liquid composition pumped up from the inside of the pan to a record medium.

Moreover, the region in which the cover layer is to be formed may be at least partially overlapped with the region to which ink is applied and may be the entire region of the record medium, a region containing all the regions to which ink is applied, or a region which is a part of the regions to which ink is applied.

For preventing unintentional folding of recorded matter during storage and the like to cause partial breakage or peeling of an image, it is suitable to apply the liquid composition to the entire region of the record medium or the region containing all the regions to which ink is applied to form the cover layer.

On the other hand, when a fold is positively given as in the production of a photobook, it is suitable to apply the liquid composition to a region containing a portion to which a fold is given before a folding processing process to form the cover layer. More specifically, in the subsequent folding processing process, it is suitable to apply the liquid composition to a region containing at least one part of a portion to which the folding processing process is performed (hereinafter also referred to as a "folding portion") to form the cover layer on the record medium to which ink is applied.

Cover Layer

In the present invention, a portion formed on a record medium by applying a liquid composition is referred to as a "cover layer". More specifically, the recorded matter of the present invention has a substrate, an ink receiving layer containing a coloring material, and a cover layer containing polyurethane resin provided in such a manner as to be at least partially overlapped with a region containing the coloring material of the ink receiving layer. Furthermore, the breaking strength of the cover layer needs to be 0.1 N or more and the breaking elongation needs to be 200% or more. By the configuration, even when a stress is applied when the record medium is folded, a phenomenon in which the ink receiving layer of the record medium is broken is suppressed, so that the fold-crack resistance of the recorded matter is improved. Furthermore, it is suitable that the breaking strength of the cover layer is 0.4 N or more and the breaking elongation is 300% or more.

It is difficult to measure the breaking strength and the breaking elongation of the cover layer itself directly from the obtained recorded matter. Therefore, in the present invention, the breaking strength and the breaking elongation of a produced film were determined by the following method, and then the "breaking strength of the cover layer" and the "breaking elongation of the cover layer" were calculated from the values by the method described later. A method for measuring the breaking strength and the breaking elongation in the present invention is described below.

Method for Producing Film

A liquid composition containing polyurethane resin particles is diluted with pure water in such a manner that the solid content density thereof is 10 wt %. A predetermined amount of the diluted liquid composition is poured into a mold having a width of 40 mm and a length of 120 mm, and then dried with a low-temperature dehumidification drier set to 30° C. to produce a film.

Method for Measuring Breaking Strength and Breaking Elongation

The film is cut in such a manner that the width is 10 mm to be used as a test piece. The breaking strength and the breaking elongation in the present invention are measured according to JIS K 7127:1999. The size and the measurement conditions of the test piece are as follows.

Test piece width: 10 mm

Test piece length: 120 mm

Initial chuck interval: 15 mm

Tensile speed: 20 mm/min

In Examples of the present invention, the measurement was performed using an autograph AGS-X (manufactured by Shimadzu Corporation) under the conditions of the measurement environment temperature is 23±2° C. and the measurement environment relative humidity is 50±5%. Then, the breaking strength and the breaking elongation of the film were determined from the testing force-displacement curve obtained by the measurement. The breaking strength and the breaking elongation of the cover layer in the present invention were determined by the following expression.

Breaking strength of cover layer=Breaking strength of film×Film thickness of cover layer/Film thickness of film Breaking elongation of cover layer=Breaking elongation of film Herein, the film thickness of each of the cover layer and the film is the average value obtained by measuring the film thickness of four points of a cross section using a scanning electron microscope.

As a method for achieving the breaking strength mentioned above, a method for adjusting the application amount of the liquid composition to be applied to a record medium is mentioned. Specifically, as the application amount in terms of solid content of the liquid composition, it is preferable to apply 3 $g/m^2$ or more of the liquid composition and it is more preferable to apply 4 g/m$^2$ or more of the liquid composition. Furthermore, the application amount in terms of solid content of the liquid composition is preferably 30 g/m$^2$ or less and more preferably 20 g/m$^2$ or less.

The film thickness in an absolute dry condition of the cover layer is preferably larger than 3 μm and more preferably 4 μm or more. Furthermore, the film thickness is preferably 30 μm or less and more preferably 20 μm or less. As described above, the film thickness of the cover layer in the present invention is the average value obtained by measuring the film thickness of four points of a cross section using a scanning electron microscope.

Liquid Composition

In the present invention, the liquid composition contains polyurethane resin particles. The viscosity at 20° C. of the liquid composition is preferably 1,000 mPa·s or less and more preferably 500 mPa·s or less. The viscosity is preferably 10 mPa·s or more. The solid content density of the liquid composition is preferably 20 wt % or more and more preferably 25 wt % or more. The solid content density is preferably 60 wt % or less. In order to form a cover layer excellent in fold-crack resistance as described above, it is suitable to apply the liquid composition in such a manner that the application amount in terms of solid content of the liquid composition is 3 g/m$^2$ or more. By the use of the liquid composition having a viscosity and a density in the ranges mentioned above, the cover layer can be uniformly formed by one application.

Polyurethane Resin Particles

In the present invention, the polyurethane resin particles are suitably in a state where the polyurethane resin particles are dispersed in water or an aqueous medium which is a mixed solvent of water and a water-soluble organic solvent (emulsion state).

In the present invention, the "polyurethane resin" is a general term for polymers having a urethane bond in the main chain and is usually obtained by a reaction between a diol compound and a diisocyanate compound. Examples of the diisocyanate compound include, for example, aliphatic diisocyanate compounds, such as hexamethylene diisocyanate and 2,2,4-trimethyl hexamethylene diisocyanate, alicyclic diisocyanate compounds, such as isophorone diisocyanate, 1,4-cyclohexane diisocyanate, and 4,4'-dicyclohexylmethane diisocyanate, araliphatic diisocyanate compounds, such as xylylene diisocyanate and tetramethyl xylene diisocyanate, aromatic diisocyanate compounds, such as toluylenediisocyanate and phenylmethanediisocyanate, and the like. Two or more kinds of the diisocyanate compounds may be used in combination. Examples of the diol compounds include, for example, diol compounds obtained by (co)polymerizing heterocyclic ethers, such as alkylene oxides, such as ethylene oxide and propylene oxide, and tetrahydrofuran. Specific examples of the diol compounds include polyether diols, such as polyethylene glycol, polypropylene glycol, polytetramethyleneether glycol, and polyhexamethyleneether glycol, polyester diols, such as polyethylene adipate, polybutylene adipate, polyneopentyl adipate, poly-3-methylpentyl adipate, polyethylene/butylene adipate, and polyneopentyl/hexyl adipate, polylactone diols, such as polycaprolactone diol, and polycarbonate diol. Among the above, the polyether type or the polycarbonate type is suitable.

The minimum film forming temperature (MFT) of the polyurethane resin particles to be used in the present invention is preferably 50° C. or less and more preferably 20° C. or less.

The average particle diameter of the polyurethane resin particles is preferably 200 nm or less and the average particle diameter is more preferably 100 nm or less. When the average particle diameter is 200 nm or more, the color development properties tend to decrease. The average particle diameter of the polyurethane resin particles is measured by a dynamic light scattering method and is determined from the analysis using the cumulant method described in "Kobunshi no Kozo (2), Sanran jikken to Keitai Kansatu, 1. Hikari Sanran" (Polymer structure (2), Scattering experiment and Form observation, Chapter 1. Light scattering) (Kobunshi Gakkai Ed, Kyoritsu Syuppan) or J. Chem. Phys., 70(B), 15 Apl., 3965 (1979).

For the polyurethane resin particles of the present invention, commercially available polyurethane resin particles can be used. Specific examples of the commercially available polyurethane resin particles include "ADEKABON TITER" series manufactured by ADEKA, "VONDIC" series and "HYDRAN" series manufactured by DIC, "Impranil" series manufactured by Beyer, "UCOAT" series, "PARMARIN" series, and "CHEMITYLEN" series manufactured by Sanyo Chemical Industries, Ltd., "Super Flex" series manufactured by Daiichi Kogyo Seiyaku Co., Ltd., "Neorez" series manufactured by Zeneca, "Sancure" series manufactured by Lubrizol Corporation, "ETERNACOLLUW" series manufactured by Ube Industries, "OLESTER" series manufactured by Mitsui Chemicals, Inc., "Acrit WBR" series manufactured by TAISEI FINE CHEMICAL CO., LTD., and the like but the commercially available polyurethane resin particles are not limited thereto. In the present invention, the polyurethane resin particles may be used alone or as a mixture of two or more kinds thereof.

Other Additives

In the present invention, various additives, such as a crosslinking agent, a surfactant, a defoaming agent, a viscosity adjuster, a pH adjuster, an antirust, an antiseptic, an antifungal agent, an antioxidant, a reduction inhibitor, an evaporation promoter, a chelating agent, and a water-soluble polymer, may be blended in the liquid composition as necessary besides the components described above.

For example, the breaking strength of a polyurethane resin coating can be increased by adding a crosslinking agent. As the crosslinking agent, a water-soluble type is suitable. For example, when the polyurethane resin has a carboxyl group, polymers having a group which can react with carboxyl groups (for example, (meth)acryl polymers, styrene.acryl-based polymers, and the like) can be used as the crosslinking agent. Moreover, as the groups which can react with carboxyl groups, an organic amino group, an oxazoline group, an aziridine group, an epoxy group, a carbodiimide group, and the like are mentioned. Only one kind or two or more kinds of the crosslinking agents may be used. As the crosslinking agent, commercially available crosslinking agents can be used. Specific examples of the commercially available crosslinking agents include Epocros series manufactured by NIPPON SHOKUBAI as oxazolines, CHEMITITE series manufactured by NIPPON SHOKUBAI as aziridines, and Carbodilite manufactured by Nisshinbo Chemical Inc., as carbodiimides. The content of the crosslinking agent is preferably 1 part by mass or more and 30 parts by mass or less and more preferably 5 parts by mass or more and 20 parts by mass or less based on 100 parts by mass of the polyurethane resin in terms of solid content.

(3) Folding Processing Process

As a folding processing process, any known method can be used. For example, a method including marking a line by pressing an edge against a record medium before folding (line marking processing), and then valley-folding a portion to which the line is marked, a method including performing folding without performing the line marking processing, and the like are mentioned.

(4) Other Processes (4-1) Pre-humidification Process

In the present invention, it is suitable to further perform a pre-humidification process of humidifying a record medium before the ink application process. In this process, before a record medium advances to an image recording position including a recording head, the record medium is humidified. By performing the pre-humidification process, the record medium is brought into a state of sufficiently absorbing water beforehand before the application of ink. In the present invention, it is suitable that the pre-humidification process is carried out by supplying humidifying air before the record medium advances to an ink application position including a recording head and is carried out under the conditions setting an atmosphere in which the temperature is 35° C. or less and the absolute humidity is 0.013 kg/kgDA or more.

(4-2) Drying Process

In the present invention, it is suitable to have a drying process after the ink application process and before the cover layer formation process. In the drying process, liquid components derived from the ink applied to the record medium may be evaporated. As a method therefor, spraying of warm air, irradiation of infrared rays or ultraviolet rays, and the like are mentioned, for example. In the drying process, liquid components derived from the ink applied to the record medium may be evaporated. As a method for the evaporation, and blowing of warm air, irradiation of infrared rays or ultraviolet rays, and the like are mentioned, for example. In the present invention, it is particularly suitable to perform the drying process by blowing warm air having a temperature of 50° C. or more to the record medium to which the ink is applied for 2 seconds or more. It is suitable that the upper limit of the temperature of the warm air is 95° C. or less and the upper limit of the blowing time is 10 seconds or less.

(4-3) Humidification Process

In the present invention, it is suitable to have a humidification process after the ink application process and before the cover layer formation process. In the humidification process, the ink receiving layer of the record medium may sufficiently absorb moisture. As a method therefor, a method including supplying humidifying air to a space between a recording head and the record medium and the like are mentioned, for example. In the present invention, it is suitable to perform the humidification process by supplying humidifying air to a space between a recording head and the record medium and to perform the humidification process under the conditions setting an atmosphere of the space between the recording head and the record medium in such a manner that the temperature is 35° C. or less and the absolute humidity is 0.013 kg/kgDA or more. The lower limit of the temperature is suitably 25° C. or more. As the preconditions therefor, the relative humidity is suitably less than 100%

Recording Device

In the present invention, a recording device has (1) an ink application means applying ink to a record medium and (2) a cover layer formation means forming a cover layer. The recording device may further have (3) a folding processing means folding recorded matter.

In the present invention, a recording device having all the means (1) to (3) may be acceptable. Moreover, a recording device which is divided into a device having the means (1), a device having the means (2), and a device having the means (3), a recording device which is divided into a device having the means (1) and (2) and a device having the means (3), or a recording device which is divided into a device having the means (1) and a device having the means (2) and (3) may be acceptable. Herein, a description is given taking a case where (1) the ink application means is provided separately from (2) the cover-layer formation means or (3) the folding processing means as an example.

(1) Ink Application Means

It is suitable for the ink application means to have an ink storage unit for storing ink and an ink application unit for discharging the ink from a recording head to apply the ink to a record medium. Furthermore, it is more suitable to have at least either a means (drying unit) for drying the record medium to which the ink is applied or a means (pre-humidifying unit) for humidifying the space between the recording head and the record medium.

Hereinafter, an example of the configuration of the ink application means in the present invention is described with reference to FIG. 1. The ink application means of FIG. 1 has a paper feed unit 3, an ink application unit 1, a cutter unit 4, a drying unit 5, an ink storage unit 6, a control unit 7, and a paper discharge unit 8 from the upstream side to the downstream side in the conveyance direction of a record medium. The paper feed unit 3 rotatably holds a record medium 2 wounded in a roll shape. The ink application unit 1 has a plurality of recording heads 1*a* corresponding to different color inks. Herein, the form having four recording heads corresponding to four kinds of inks is described but the number of inks is not limited thereto. Each ink is supplied to the recording heads 1*a* through a corresponding ink tube (not illustrated) from the ink storage unit 6.

In the ink application unit 1, a recording-medium conveyance path crosses facing the recording heads 1*a* and a conveyance mechanism for conveying a record medium along the recording-medium conveyance path is provided. The plurality of recording heads 1*a* and the conveyance mechanism are stored in a substantially closed space in a case 1*b*. On the upstream side in the conveyance direction of the recording heads 1*a*, a pre-humidifying unit 1*c* is provided which pre-humidifies the record medium before the record medium advances to the ink application position including the recording heads 1*a*.

The cutter unit 4 is a unit for cutting a rolled paper-like record medium to which ink is applied by the ink application unit 1 into a predetermined size and is provided with a cutter mechanism. The drying unit 5 is a unit for drying the cut record medium in a short time and is provided with a warm air device (not illustrated) configured from a heater heating gas and a fan generating the flow of the heated gas and a plurality of conveyance rollers arranged along the conveyance path of a record medium. The paper discharge unit 8 stores the cut record medium discharged from the drying unit 5, and a plurality of record media are accumulated therein. The control unit 7 is a controller controlling various control and drive of the entire recording device.

(2) Cover Layer Formation Means

It is suitable for the cover layer formation means to have a paper feed unit, a liquid composition storage unit, and a paper discharge unit in addition to a liquid composition application unit applying a liquid composition. Among the above, for the liquid composition application unit, it is suitable to use a pumping-up roll type coating device.

As a general cover layer formation means, a three-roll direct coater is known. However, since the three-roll direct coater is not suitable for applying a liquid composition having a high solid content density and a high viscosity, the solid content density and the viscosity need to be reduced for application. Therefore, it is sometimes difficult to uniformly apply the liquid composition in an application amount required for achieving fold-crack resistance at one time. This is because, with the three-roll direct coater, a period of time while the liquid composition to be applied touches the atmosphere is long due to the structure, and therefore the liquid composition is likely to be thickened and solidified in the path. For the reasons described above, it is suitable to use a pumping-up roll type coating device in the present invention.

Figure 2:
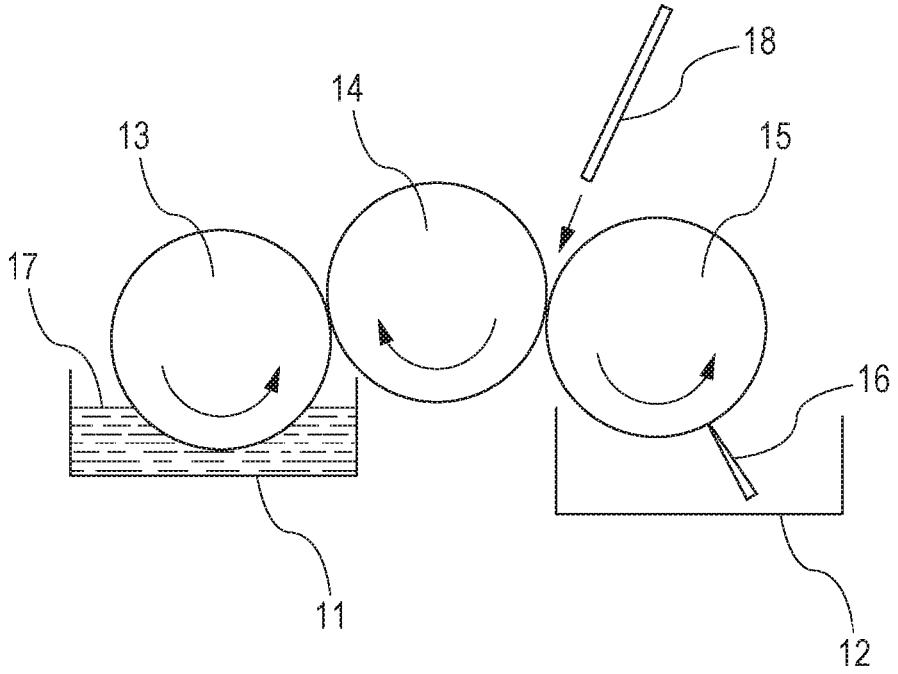
FIG. 2 is a schematic view illustrating an example of the configuration of a pumping-up roll type coating device.

An example of the configuration of a pumping-up roll type coating device suitable as the cover layer formation means of the present invention is illustrated in FIG. 2. The pumping-up roll type coating device of FIG. 2 has a pan 11 storing a liquid composition 17, a pumping-up roll 13, a coating roll 14, a back roll 15, a blade 16, and a collection pan 12 (a collection container). First, the liquid composition is pumped up from the pan 11 using the pumping-up roll 13, and then supplied to the coating roll 14. Then, by letting a record medium 18 on which an image is recorded pass between the coating roll 14 and the back roll 15, a cover layer is formed on the record medium 18. Thereafter, the liquid composition which is not used is removed by the blade 16 to be collected by the collection pan 12. Although not illustrated, the collected liquid composition may be used for coating again by supplying the same to the pan 11.

In the present invention, the pumping-up roll 13 and the coating roll 14 are suitably rolls made of rubber. Examples of the types of rubber to be used include, for example, natural rubber, styrene-butadiene rubber, butadiene rubber, nitrile rubber, acrylic rubber, urethane rubber, silicone rubber, and the like. The back roll 15 is suitably a plating-finished metal roll.

Since the pumping-up roll type coating device pumps up the liquid composition directly from the pan, the path in which the liquid composition touches the atmosphere is very short, and thus an increase in the viscosity resulting from the evaporation of a solvent can be suppressed. When the application is continuously performed for about 5 hours, the viscosity increase rate of the liquid composition in this period is suppressed to preferably 10% or less and more preferably 5% or less. The viscosity increase rate is calculated from the viscosity of the liquid composition in the pan when the application is completed and the viscosity of the liquid composition in the collection pan to the viscosity of the liquid composition in the pan when the application is started. The application amount with the pumping-up roll type coating device can be controlled by adjusting the physical property values, such as the solid content density and the viscosity of the liquid composition. Moreover, the application amount can be controlled also by adjusting the shape of the roll surface, the rotation speed of the roll, and the interval and the pressure between each roll.

It is suitable to apply the liquid composition, and then warm the same to form a cover layer. The drying is performed at a temperature of preferably 70° C. or more and more preferably 80° C. or more. As a drying method, blowing of warm air, irradiation of infrared rays or ultraviolet rays, and the like are mentioned, for example. When the temperature is less than 70° C., the drying needs to be performed for a relatively long time. Specifically, it is suitable to perform the drying for 5 minutes or more. The polyurethane resin is sufficiently formed into a film by being dried under the drying conditions, and therefore the drying conditions are suitable.

(3) Folding Processing Means

It is suitable for a folding processing means to have a paper feed unit and a paper discharge unit in addition to a folding unit. A mechanism may be acceptable in which, by connecting the paper feed unit in the folding processing means to the paper discharge unit in the cover layer formation means, the cover layer formation process and the folding processing process can be continuously performed.

EXAMPLES

Hereinafter, the present invention is described in more detail with reference to Examples and Comparative Examples. The present invention is not limited to Examples described below without deviating from the gist thereof. In the description of Examples described below, "part(s)" are based on mass unless otherwise particularly specified.

Production of Record Medium

Production of Substrate 80 parts of a Laulholz (deciduous) Bleached Kraft Pulp (LBKP) having a Canadian Standard Freeness of 450 mLCSF, 20 parts of a Nadelholz (coniferous) Bleached Kraft Pulp (NBKP) having a Canadian Standard Freeness of 480 mLCSF, 0.60 part of cationized starch, 10 parts of heavy calcium carbonate, 15 parts of light calcium carbonate, 0.10 part of alkyl ketene dimer, and 0.030 part of cationic polyacrylamide were mixed, and then water was added in such a manner that the solid content was 3.0 mass % to thereby obtain a paper stuff. Subsequently, the paper stuff was formed into paper with a fourdrinier paper machine, and then subjected to three-stage wet pressing, followed by drying with a multi-cylinder dryer. Thereafter, the resulting paper was impregnated with an aqueous oxidized starch solution in such a manner that the solid content after drying was 1.0 g/m$^2$ using a size press apparatus, and then dried. Furthermore, the resulting paper was subjected to finishing treatment with a machine calendar to produce a base paper having a basis weight of 155 g/m$^2$. Subsequently, a resin composition containing 70 parts of low-density polyethylene, 20 parts of high-density polyethylene, and 10 parts of titanium oxide was applied onto one surface (defined as the front surface) of the base paper in such a manner that the film thickness was 25.0 μm. Then, immediately after the application of the resin composition, embossing processing was performed with a cooling roll having regular irregularity on the front surface. The arithmetic average roughness (Ra) when the cutoff value specified by JIS B 0601:2001 of the front surface of the obtained base paper was 0.8 mm was 1.8 μm. Furthermore, a resin composition containing 50 parts of low-density polyethylene and 50 parts of high-density polyethylene was applied onto the back surface of the base paper in such a manner that the film thickness was 30 μm to obtain a substrate.

Preparation of Coating Liquid for Ink Receiving Layer

Preparation of Alumina Hydrate Sol 1.5 parts of methanesulfonic acid was added as a deflocculation acid to 333 parts of ion exchange water to give an aqueous methanesulfonic acid solution. 100 parts of alumina hydrate (DISPERAL HP14, manufactured by Sasol) was added in a small amount while stirring the aqueous methanesulfonic acid solution with a homomixer (T.K. Homomixier MARK II 2.5, manufactured by Tokusyu Kika Kogyo Co., Ltd.) under the rotation conditions of 3000 rpm. After the completion of the addition, the mixture was further stirred for 30 minutes to thereby prepare an alumina hydrate sol with a solid content of 23.0 mass %.

Preparation of Alumina Sol 1.5 parts of methanesulfonic acid was added as a deflocculation acid to 333 parts of ion exchange water to give an aqueous methanesulfonic acid solution. 100 parts of alumina (AEROXIDE Alu C, manufactured by EVONIK Industries A.G.) was added in a small amount while stirring the aqueous methanesulfonic acid solution with a homomixer (T.K. Homomixier MARK II 2.5, manufactured by Tokusyu Kika Kogyo Co., Ltd.) under the rotation conditions of 3000 rpm. After the completion of the addition, the mixture was further stirred for 30 minutes to thereby prepare an alumina sol with a solid content of 23.0 mass %.

Preparation of Aqueous Polyvinyl Alcohol Solution 100 parts of polyvinyl alcohol (PVA235, manufactured by Kuraray Co., Ltd., Saponification degree of 88%, Average degree of polymerization 3,500) was added to 1150 parts of ion exchange water under stirring. Then, the mixture was melted by heating at 90° C. to prepare an aqueous polyvinyl alcohol solution having a solid content density of 8 mass %.

Preparation of Coating Liquid for Ink Receiving Layer 1

The alumina hydrate sol and the alumina sol prepared above were mixed in such a manner that the solid content mass ratio of the alumina hydrate to the alumina was 70:30. The aqueous polyvinyl alcohol solution was mixed in such a manner that the polyvinyl alcohol was 6 parts by mass in terms of solid content based on the total solid content (100 parts by mass) of the alumina hydrate and the alumina contained in the mixed sol. Next, an aqueous orthoboric acid solution having a solid content density of 5 mass % was mixed in such a manner that the orthoboric acid was 16.4 mass % in terms of solid content based on 100 parts by mass of the solid content of the polyvinyl alcohol in the mixed solution. Furthermore, a surfactant (Trade name: Surfynol 465, manufactured by Nisshin Chemical Co., Ltd.) was mixed in such a manner as to be 0.1 mass % based on the total amount of the coating liquid to prepare a coating liquid for ink receiving layer 1.

Preparation of Coating Liquid for Ink Receiving Layer 2

The aqueous polyvinyl alcohol solution was mixed with the alumina hydrate sol in such a manner that the polyvinyl alcohol was 10 parts by mass in terms of solid content based on 100 parts by mass of the alumina hydrate solid content. Next, an aqueous orthoboric acid solution having a solid content density of 5 mass % was mixed in such a manner that the orthoboric acid was 5.8 mass % in terms of solid content based on 100 parts by mass of the solid content of the polyvinyl alcohol in the mixed solution to prepare a coating liquid for ink receiving layer 2.

Production of Record Medium

Production of Record Medium 1

The coating liquid for ink receiving layer 1 and the coating liquid for ink receiving layer 2 were applied to the front surface side of the substrate in such a manner that, the dry film thickness of the coating liquid for ink receiving layer 2 was 25 μm and the dry film thickness of the coating liquid for ink receiving layer 1 thereon was 10 μm, 35 μm in total, with a multilayer slide hopper type coating device. Subsequently, the resultant substrate was dried at 60° C. to obtain a record medium 1.

Production of Record Medium 2

A record medium 2 was obtained in the same manner as the record medium 1 in the Production of record medium 1 above, except applying only the coating liquid for ink receiving layer 1 in a monolayer in such a manner that the dry film thickness was 35 μm.

Ink Application Process

An ink cartridge filled with a black ink of the following composition was mounted on a recording device having the ink application means illustrated in FIG. 2. Then, a solid image with a recording duty of 100% was recorded on the record media produced above under the conditions of a temperature of 23° C. and a relative humidity of 50%, whereby the record media to which ink was applied were obtained. In the recording device described above, the condition where 8 ink droplets with a volume of 2.5 pL were applied to a unit region of 1/1200 inch×1/1200 inch at a resolution of 1200 dpi×1200 dpi is defined that the recording duty is 100%.

Composition of Ink

Ink was prepared in such a manner as to have the following composition. The preparation of the ink was performed by mixing the components of the following composition, sufficiently stirring the mixture, and then filtering the resultant mixture under pressure with a filter having a pore size of 0.2 μm. Acetylenol E100 is an acetylenol-based surfactant manufactured by Kawaken Fine Chemicals.

| | |
|---|---|
| Black dye represented by the formula shown below (in which M is Li) | 5.0 parts |
| Glycerol | 5.0 parts |
| Bishydroxyethyl sulfone | 10.0 parts |
| 1,5-pentane diol | 5.0 parts |
| Acetylenol E100 | 0.4 part |
| Pure water | 74.6 parts |

Chem. 1

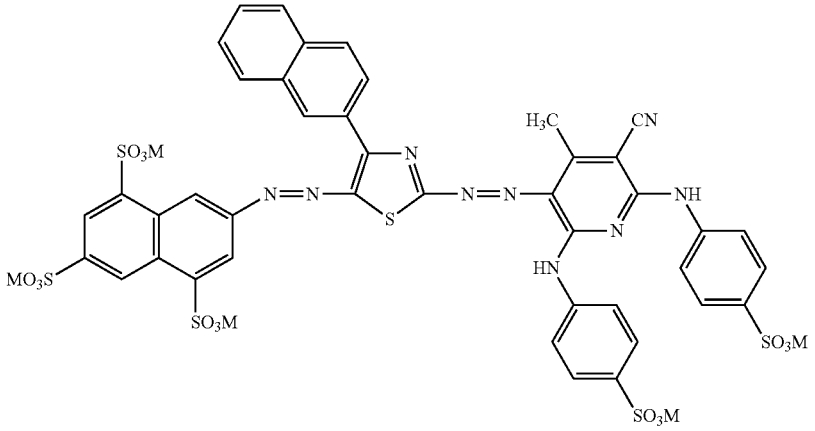

20

Cover Layer Formation Process

Preparation of Liquid Composition

Polyurethane resin particles (Super Flex 150HS, manufactured by Daiichi Kogyo Seiyaku Co., Ltd.) was diluted with pure water to be adjusted in such a manner as to have a solid content density of 38% to obtain a liquid composition 1. Liquid compositions 2 to 26 were prepared in the same manner as the liquid composition 1 using polyurethane resin particles shown in Table 1.

Cover Layer Formation Process

The liquid compositions prepared above were applied to the entire surface of the record media to which the ink was applied using a pumping-up roll type coating device, and then dried at a temperature of 80° C. to obtain recorded matter on which a cover layer was formed. The production conditions of the recorded matter were shown in Table 1. The liquid composition was not applied to recorded matter 28. Then, films were produced by the method described above. Then, the breaking strength and the breaking elongation of the films were measured by the method described above, and then the breaking strength and the breaking elongation of the cover layer were determined from the results. The results are shown in Table 1.

Evaluation Results

The obtained recorded matter was folded in two in such a manner that the ink applied surface was positioned inside, and then held for one night while applying a 1000 kg load using a pressing machine to give a fold. The record media with the fold were opened and closed 10 times, and then the folded portion was visually confirmed to evaluate the fold-crack resistance of the recorded matter. The evaluation criteria are as follows. In the present invention, AA and A of the following evaluation criteria were suitable levels and B and C were unacceptable levels. The evaluation results are shown in Table 1.

AA: No white lines were observed.

A: A white line was slightly observed.

B: A white line was clearly observed.

C: A wide white line was clearly observed.

TABLE 1

Production conditions and evaluation results of record media

| | | Liquid composition | | | | |
|---|---|---|---|---|---|---|
| | Type of recording | | Polyurethane resin particles | | Solid content | Viscosity |
| Example No. | medium to be used | Type | Type (Product name) | Manufacturer | density (mass %) | @20° C. (mPa · s) |
| Ex. 1 | Recording medium 2 | Liquid composition 1 | Super Flex 150HS | Daiichi Kogyo Seiyaku Co., Ltd. | 38.4 | 98 |
| Ex. 2 | Recording medium 2 | Liquid composition 2 | Turboset Ultra Pro | Lubrizol | 37.0 | 500 |
| Ex. 3 | Recording medium 2 | Liquid composition 3 | UW-5002 | Ube Industries | 29.9 | 48 |
| Ex. 4 | Recording medium 2 | Liquid composition 4 | WBR-2018 | TAISEI FINE CHEMICAL CO., LTD. | 32.6 | 290 |
| Ex. 5 | Recording medium 2 | Liquid composition 5 | Super Flex 470 | Daiichi Kogyo Seiyaku Co., Ltd. | 37.6 | 165 |
| Ex. 6 | Recording medium 2 | Liquid composition 6 | HUX-561S | ADEKA | 38.3 | 35 |
| Ex. 7 | Recording medium 2 | Liquid composition 7 | CHEMITYLEN GA-500 | Sanyo Chemical Industries, Ltd. | 49.8 | 370 |
| Ex. 8 | Recording medium 2 | Liquid composition 8 | UCOAT UX-310 | Sanyo Chemical Industries, Ltd. | 39.8 | 960 |
| Ex. 9 | Recording medium 2 | Liquid composition 9 | WEM-3008 | TAISEI FINE CHEMICAL CO., LTD. | 34.4 | 13 |

TABLE 1-continued

Production conditions and evaluation results of record media

| | | | | | | |
|---|---|---|---|---|---|---|
| Ex. 10 | Recording medium 2 | Liquid composition 10 | Sancure 2310 | Lubrizol | 40.0 | 500 |
| Ex. 11 | Recording medium 2 | Liquid composition 11 | UW-1005-E | Ube Industries | 29.8 | 49 |
| Ex. 12 | Recording medium 2 | Liquid composition 12 | WBR-016U | TAISEI FINE CHEMICAL CO., LTD. | 30.2 | 750 |
| Ex. 13 | Recording medium 2 | Liquid composition 13 | UCOAT UX-150 | Sanyo Chemical Industries, Ltd. | 30.4 | 100 |
| Ex. 14 | Recording medium 2 | Liquid composition 14 | Sancure 777 | Lubrizol | 35.0 | 75 |
| Ex. 15 | Recording medium 2 | Liquid composition 15 | Sancure PC-55 | Lubrizol | 42.0 | 500 |
| Ex. 16 | Recording medium 2 | Liquid composition 16 | Sancure 20025F | Lubrizol | 48.0 | 500 |
| Ex. 17 | Recording medium 2 | Liquid composition 17 | Super Flex 650 | Daiichi Kogyo Seiyaku Co., Ltd. | 26.1 | 37 |
| Ex. 18 | Recording medium 1 | Liquid composition 1 | Super Flex 150HS | Daiichi Kogyo Seiyaku Co., Ltd. | 38.4 | 98 |
| Comp. Ex. 1 | Recording medium 2 | Liquid composition 18 | HUX-320 | ADEKA | 32.1 | 28 |
| Comp. Ex. 2 | Recording medium 2 | Liquid composition 19 | Super Flex 130 | Daiichi Kogyo Seiyaku Co., Ltd. | 30.2 | — |
| Comp. Ex. 3 | Recording medium 2 | Liquid composition 20 | Super Flex 126 | Daiichi Kogyo Seiyaku Co., Ltd. | 25.3 | — |
| Comp. Ex. 4 | Recording medium 2 | Liquid composition 21 | WBR-2101 | TAISEI FINE CHEMICAL CO., LTD. | 25.0 | 200 |
| Comp. Ex. 5 | Recording medium 2 | Liquid composition 22 | Super Flex 500M | Daiichi Kogyo Seiyaku Co., Ltd. | 44.6 | 209 |
| Comp. Ex. 6 | Recording medium 2 | Liquid composition 23 | Super Flex 420 | Daiichi Kogyo Seiyaku Co., Ltd. | 32.3 | 148 |
| Comp. Ex. 7 | Recording medium 2 | Liquid composition 24 | HUX-282 | ADEKA | 30.9 | 80 |
| Comp. Ex. 8 | Recording medium 2 | Liquid composition 25 | HYDRAN HW-350 | DIC | 25.0 | 31 |
| Comp. Ex. 9 | Recording medium 2 | Liquid composition 1 | Super Flex 150HS | Daiichi Kogyo Seiyaku Co., Ltd. | 10.3 | 98 |
| Comp. Ex. 10 | Recording medium 2 | — | — | — | — | — |

| Example No. | Application amount of liquid composition ($g/cm^2$) | Cover layer Film thickness (μm) | Cover layer Breaking strength (N) | Cover layer Breaking elongation (%) | Evaluation results Fold-crack resistance |
|---|---|---|---|---|---|
| Ex. 1 | 16.3 | 6.3 | 0.71 | 228 | A |
| Ex. 2 | 15.2 | 5.6 | 0.53 | 313 | AA |
| Ex. 3 | 11.8 | 3.5 | 0.19 | 339 | A |
| Ex. 4 | 9.3 | 3.0 | 0.32 | 409 | A |
| Ex. 5 | 14.4 | 5.4 | 0.43 | 430 | AA |
| Ex. 6 | 13.0 | 5.0 | 0.43 | 554 | AA |
| Ex. 7 | 16.3 | 8.1 | 0.56 | 550 | AA |
| Ex. 8 | 19.2 | 7.6 | 0.55 | 575 | AA |
| Ex. 9 | 16.4 | 5.6 | 0.46 | 550 | AA |
| Ex. 10 | 13.4 | 5.4 | 0.54 | 708 | AA |
| Ex. 11 | 9.1 | 2.7 | 0.16 | 764 | A |
| Ex. 12 | 6.6 | 2.0 | 0.14 | 668 | A |
| Ex. 13 | 17.4 | 5.3 | 0.32 | 718 | A |
| Ex. 14 | 15.0 | 5.3 | 0.58 | 476 | AA |
| Ex. 15 | 15.2 | 6.4 | 0.16 | 910 | A |
| Ex. 16 | 15.4 | 7.4 | 0.37 | 811 | A |
| Ex. 17 | 13.0 | 3.4 | 0.41 | 211 | A |
| Ex. 18 | 16.4 | 6.3 | 0.71 | 228 | AA |
| Comp. Ex. 1 | 16.2 | 5.2 | 0.23 | 188 | B |
| Comp. Ex. 2 | 16.2 | 4.9 | 0.07 | 104 | C |
| Comp. Ex. 3 | 19.0 | 4.8 | 0.08 | 214 | B |
| Comp. Ex. 4 | 12.6 | 3.1 | 0.43 | 106 | B |
| Comp. Ex. 5 | 15.1 | 6.7 | 0.46 | 111 | B |
| Comp. Ex. 6 | 11.5 | 3.7 | 0.05 | 159 | B |
| Comp. Ex. 7 | 11.8 | 3.7 | 0.08 | 1049 | B |
| Comp. Ex. 8 | 19.3 | 4.8 | 0.32 | 183 | B |

TABLE 1-continued

| Production conditions and evaluation results of record media | | | | | |
|---|---|---|---|---|---|
| Comp. Ex. 9 | 5.8 | 0.6 | 0.07 | 228 | C |
| Comp. Ex. 10 | — | — | — | — | |

Examination of Drying Conditions 15.0 g/m$^2$ of the liquid composition 14 was applied to the entire surface of the record media 2 to which the ink was applied using a pumping type roll coater, and then the record media 2 were dried while changing the drying conditions (temperature and time) shown in Table 2 to obtain recorded matter on which a cover layer was formed.

The obtained recorded matter was folded in two in such a manner that the ink applied surface was positioned inside, and then held for 24 hours while applying a 1000 kg load using a pressing machine. Thereafter, the recorded matter which was able to be opened was evaluated as A and the recorded matter in which the ink applied surfaces thereof were stuck to each other and which was not able to be opened was evaluated as B. The results are shown in Table 2.

TABLE 2

| Examination of drying conditions | | | | | |
|---|---|---|---|---|---|
| | | Drying temperature | | | |
| | | 50° C. | 65° C. | 80° C. | 100° C. |
| Drying time | 20 seconds | B | B | A | A |
| | 40 seconds | B | B | A | A |
| | 60 seconds | B | B | A | A |
| | 3 minutes | B | B | A | A |
| | 5 minutes | B | A | A | A |
| | 10 minutes | A | A | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-037023, filed Feb. 26, 2015, which is hereby incorporated by reference herein in its entirety.

What is claimed is:

1. A recording method, comprising:

applying ink to a record medium, wherein the record medium comprises a base paper having a density of 0.6 g/cm$^3$ or more and 1.2 g/cm$^3$ or less;

forming a cover layer by applying a liquid composition containing polyurethane resin particles to the record medium to which the ink is applied in such a manner as to be at least partially overlapped with a region to which the ink is applied, wherein breaking strength of the cover layer is 0.43N or more and 0.58N or less, and breaking elongation of the cover layer is 313% or more and 708% or less; and after forming the cover layer, folding the record medium, wherein an application amount in terms of solid content of the liquid composition is 13.0 g/m$^2$ or more and 19.2 g/m$^2$ or less.

2. The recording method according to claim 1, wherein, in the formation of the cover layer, a roll type coating device having a pan storing the liquid composition and a roll applying the liquid composition pumped up from inside of the pan to the record medium is used.

3. The recording method according to claim 1, comprising, after the formation of the cover layer, performing drying at a temperature of 70° C. or more.

4. The recording method according to claim 1, wherein the record medium has a substrate and an ink receiving layer.

5. The recording method according to claim 4, wherein the substrate is a water resistant substrate.

6. The recording method according to claim 1, wherein a film thickness in an absolute dry condition of the cover layer is 4 μm or more and 20 μm or less.

7. The recording method according to claim 1, wherein a minimum film forming temperature of the polyurethane resin particles is 50° C. or less.

8. The recording method according to claim 1, wherein an average particle diameter of the polyurethane resin particles is 100 nm or less.

9. The recording method according to claim 1, wherein a film thickness in an absolute dry condition of the cover layer is 5.0 μm or more and 8.1 μm or less.

10. The recording method according to claim 1, wherein a viscosity 20° C. of the liquid composition is 13 mPa·s or more and 960 mPa·s or less.

11. The recording method according to claim 1, wherein a solid content density of the liquid composition is 34.4 mass % or more and 49.8 mass % or less.

12. The recording method according to claim 1, wherein the cover layer is a surface layer of a recorded matter which is formed by applying the ink and the liquid composition to the record medium.

* * * * *